United States Patent [19]

Wernsing

[11] 4,207,010

[45] Jun. 10, 1980

[54] DIGITAL SYSTEM FOR CONTROL OF AN ELECTRIC TYPEWRITER

[76] Inventor: William O. Wernsing, 125 Northview Rd., Ithaca, N.Y. 14850

[21] Appl. No.: 925,187

[22] Filed: Jul. 17, 1978

[51] Int. Cl.[2] ..... B41J 5/30; B41J 23/34

[52] U.S. Cl. ..... 400/66; 400/474

[58] Field of Search ..... 400/51, 61, 62, 66, 400/70, 473, 474

[56] References Cited

U.S. PATENT DOCUMENTS

| | | | |
|---|---|---|---|
| 3,340,987 | 9/1967 | Bastian | 400/51 |
| 3,414,104 | 12/1968 | Frick | 400/51 |
| 3,502,187 | 3/1970 | Becking et al. | 400/62 |
| 3,713,523 | 1/1973 | Niemietz | 400/51 |
| 3,837,458 | 9/1974 | Bretti et al. | 400/62 |
| 4,023,664 | 5/1977 | Baffo et al. | 400/62 |

FOREIGN PATENT DOCUMENTS

| | | | |
|---|---|---|---|
| 1153399 | 9/1957 | France | 400/66 |
| 1411549 | 10/1975 | United Kingdom | 400/51 |

*Primary Examiner*—Paul T. Sewell

*Attorney, Agent, or Firm*—George E. Clark

[57] ABSTRACT

An electric typewriter of the type having individual type elements for each character has attached thereto a system for controlling the actuation of the type elements and the control functions of the typewriter by digital signals. The digital signals may emanate from a remote central processing unit or other device. The control system is an attachment to the typewriter which does not interfere with the normal manual operation of the typewriter. The control system is mounted in a housing which is placed under the typewriter in predetermined alignment with the key lever actuation means and employs an electromagnetic actuator to set a condition for a mechanical actuator for each key lever. A mechanical actuator initiates a key stroke if the electromagnetic actuator is positioned in an ON position and does not initiate a key stroke if the electromagnetic actuator is in the OFF condition. The electromagnetic actuator does not supply power for the key stroke operation but merely sets a condition for the mechanical actuator which initiates a key stroke through the typewriter key power drive to operate and print a character.

10 Claims, 16 Drawing Figures

DIGITAL SYSTEM FOR CONTROL OF AN ELECTRIC TYPEWRITER

BACKGROUND OF THE INVENTION

The present invention relates to electric typewriter control systems and more particularly to a digital control system for controlling the actuation of individual type elements in an electric typewriter.

In the prior art, there are many devices for controlling the printing of characters in electric typewriters.

For example, the apparatus described in U.S. Pat. No. 3,658,161 shows how a code bail typewriter may be automatically and digitally controlled by the use of an electromagnetic actuation system. The system of the patent does not deal with individual key levers for each character but rather with code bails which must be operated in predetermined combinations to cause a particular character to be printed. Further, the system of the patent requires a synchronous operation and uses the existing motor rather an asynchronous system which employs a separate motor. Further, the system of the present requires that the electromagnet operate levers that transmit the operating power. This requires that the individual levers be large and bulky and would not be adaptable to an electric typewriter having individual key levers for each character to be printed.

Another patent which shows a control system for controlling an electric typewriter is U.S. Pat. No. 2,687,199 which shows apparatus for controlling individual key levers on a standard electric typewriter. The electromagnetic devices actually supply power and are large and bulky and are not economical or practical in that the center to center spacing of the magnets may not permit use of the system with a row of 44 key levers.

U.S. Pat. No. 3,294,117 shows an encoding system which reduces the number of solenoids or electromagnets required.

U.S. Pat. No. 3,372,788, shows a system for controlling the functional operations of an electric typewriter such as carriage return, back space, etc.

U.S. Pat. No. 3,420,351, shows apparatus for attaching and detaching a mechanism to operate an electric typewriter from a remote location. The primary thrust of this patent appears to be an approach to coupling the remote actuation device to the key lever.

U.S. Pat. No. 3,452,852 shows an electromagnetic system for controlling the actuation of key levers by a system which is mounted above the key levers and wherein the electromagnet supplies the power for the key lever actuation.

U.S. Pat. No. 3,502,187 shows the use of electromagnets to latch a bar which operates a key stroke. The patent appears to consider a system which is integral to the typewriter and not an accessory, attachment or add on device.

Each of the teachings in the patents briefly discussed above has certain disadvantages either in complexity of the mechanism, the cost of the apparatus, or in limitation of function or versatility.

Some of the patents show apparatus which only operate code bail type typewriter mechansims such as the "IBM Selectric". Others of the patents show apparatus unduely complex and costly.

Still other patents in this field show systems which prohibit the typewriter from being used in its intended mode as a manual typewriter in addition to use as a remote print out device.

SUMMARY OF THE INVENTION

Therefore, it is an object of the present invention to actuate in a predetermined sequence, a group of key levers in an electric typewriter of the type having a separate actuator for each key.

It is another object to actuate key levers as above by a system which permits the manual operation of the keyboard without interference or mechanical change.

It is yet another object of the present invention to actuate key levers in an electric typewriter by an attachment device which operates in an asynchronous manner and supplies actuating power to the key lever to be operated.

It is yet another object of the present invention to actuate the key levers as above by a system which employs electromagnetic actuators to set a digital condition to indicate whether a particular key lever is to be actuated or not.

Accordingly, an electric typewriter of the type having separate actuators for each key has attached thereto a system for individually actuating the various keys of a typewriter wherein the attachment includes an electromagnetic actuator for each key which is digitally controlled to set a print condition as required under the control of a remote digital system or the like.

It is a feature of the present invention that the manual operation of the typewriter keyboard is retained without interference.

It is another feature of the present invention that the attachment may be removed without mechanical changes to the typewriter.

Yet another feature to the present invention is that the operation of the attachment is asynchronous to the operation of the typewriter and it does not derive actuating power from the typewriter but rather from a motor contained in the attachment system.

It is yet another feature of the present invention that the individual electromagnetic actuators for each key are used to set a print condition and do not supply or transmit key lever actuation power thus allowing the actuators to be relatively thin and lightweight.

The present invention will be further described by way of example with reference to the following description and with reference to the accompanying drawing in which:

FIG. **4*a*** is a side view showing the operation of the actuation means according to the present invention wherein the electromagnetic actuator has not been selected to print a particular character.

Figure 4C:
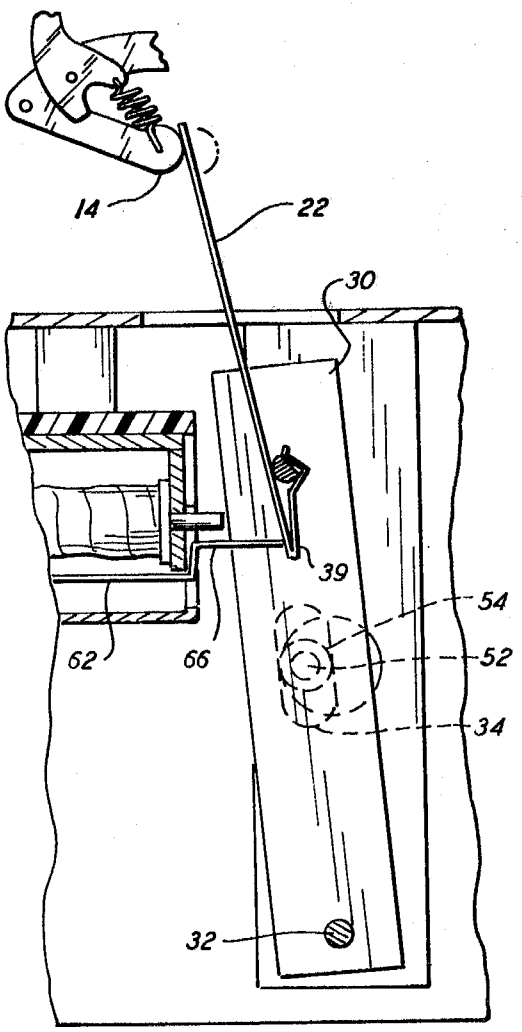
Figure 4B:
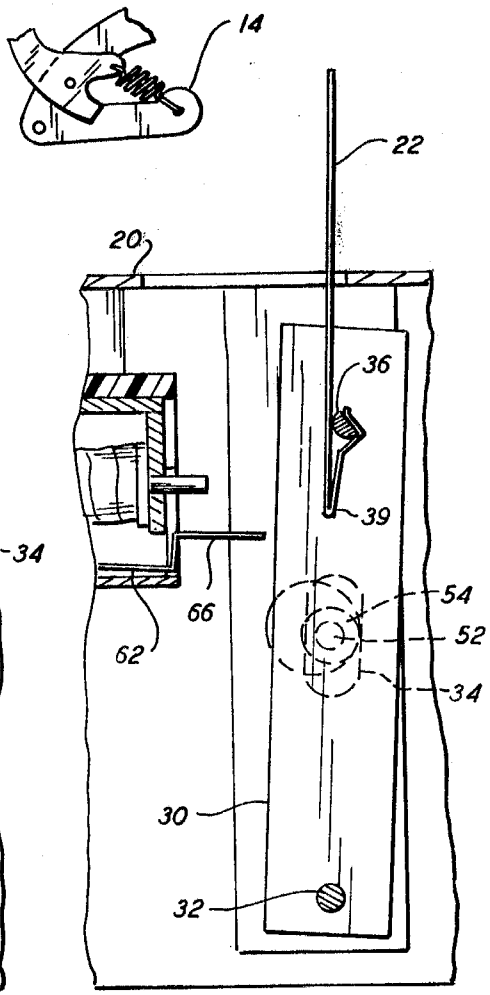
Figure 4A:
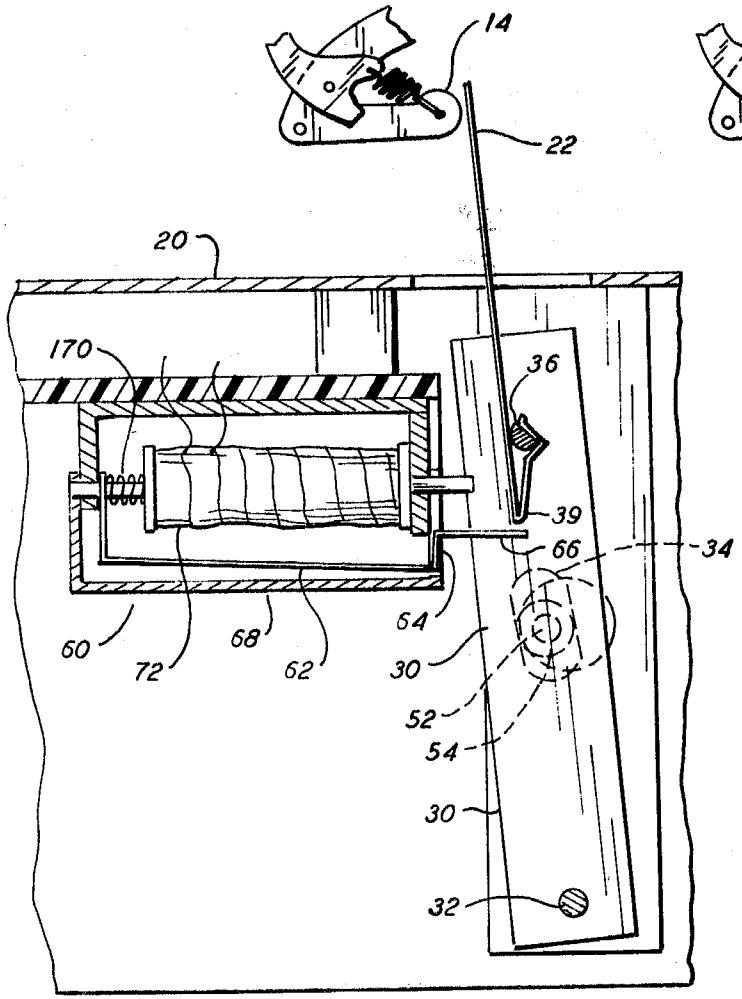

FIG. **4*b* shows the actuator as in FIG. 4*a*** wherein the drive motor has moved the actuation frame away from the key lever.

FIG. 4c shows the actuator lever being driven against the key lever in a condition wherein the electromagnetic actuator has been set to the print position.

Figure 5:
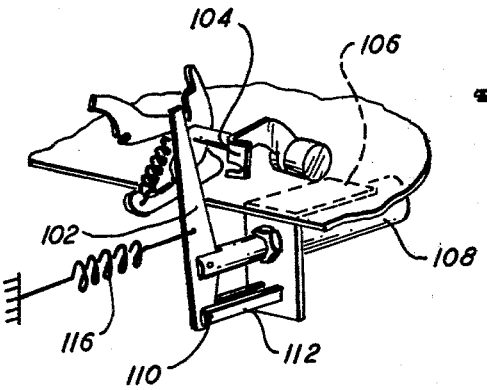

FIG. 5 is a perspective view of a case shift solenoid according to the present invention.

Figure 6:
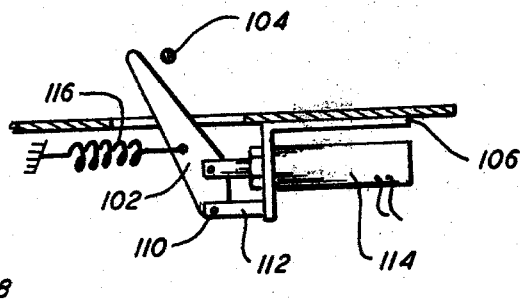

FIG. 6 is a side view of a case shift solenoid as in FIG. 5.

Figure 7:
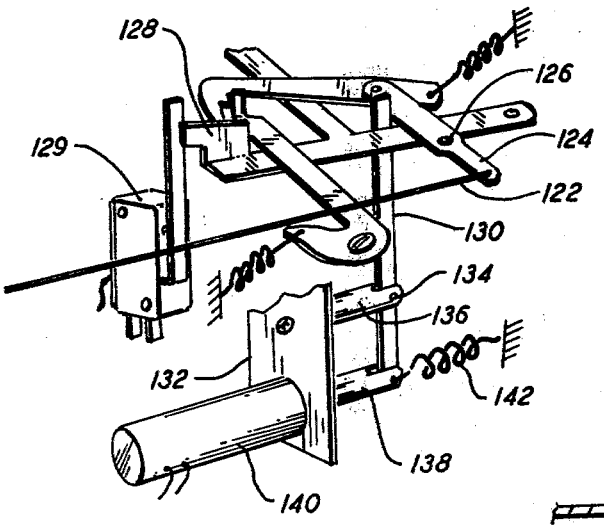

FIG. 7 is a perspective of a carriage return solenoid mechanism according to the present invention.

Figure 8:
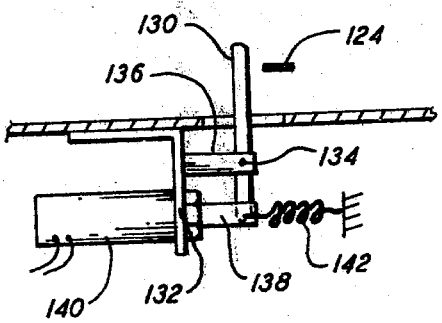

FIG. 8 is a side view of a carriage return solenoid mechanism as in FIG. 7.

Figure 9A:
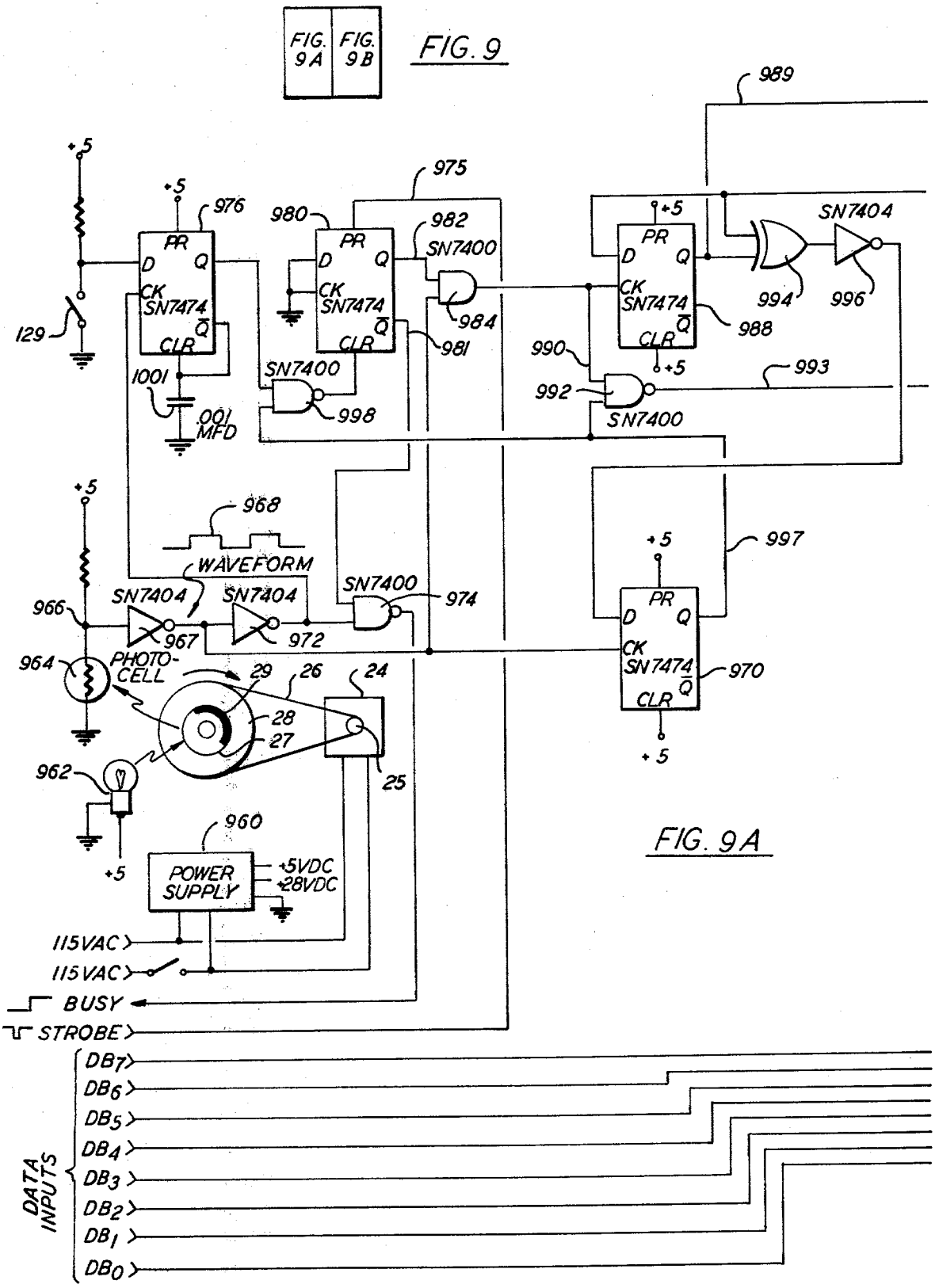
Figure 9B:
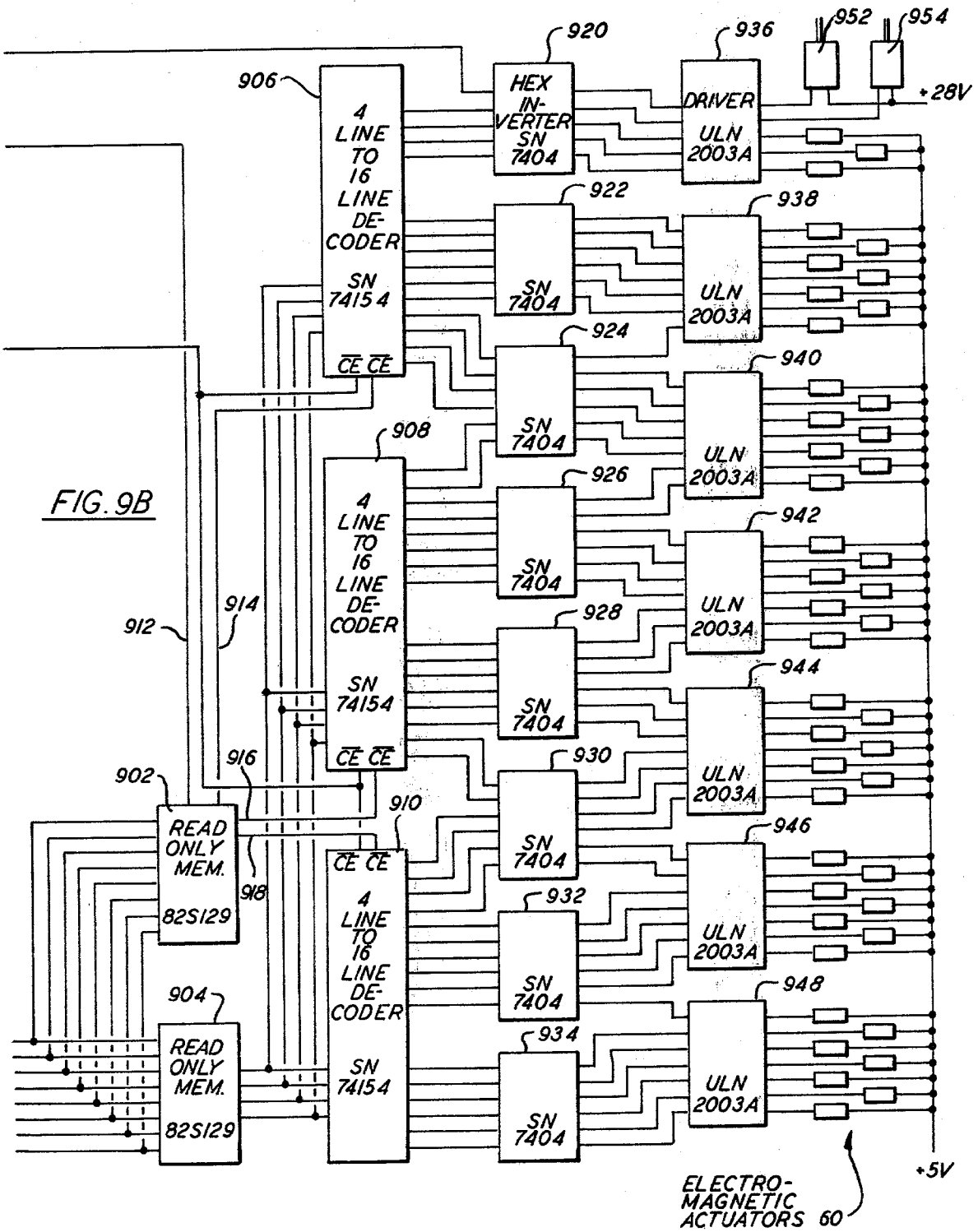

FIG. 9 shows how FIGS. 9A and 9B are related to eachother.

FIG. 9A is a left portion of a schematic block diagram of a digital control system according to a first embodiment of the present invention.

FIG. 9B is a right portion of a schematic block diagram of a digital control system according to the present invention.

Figure 10:
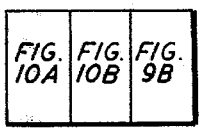
Figure 10A:
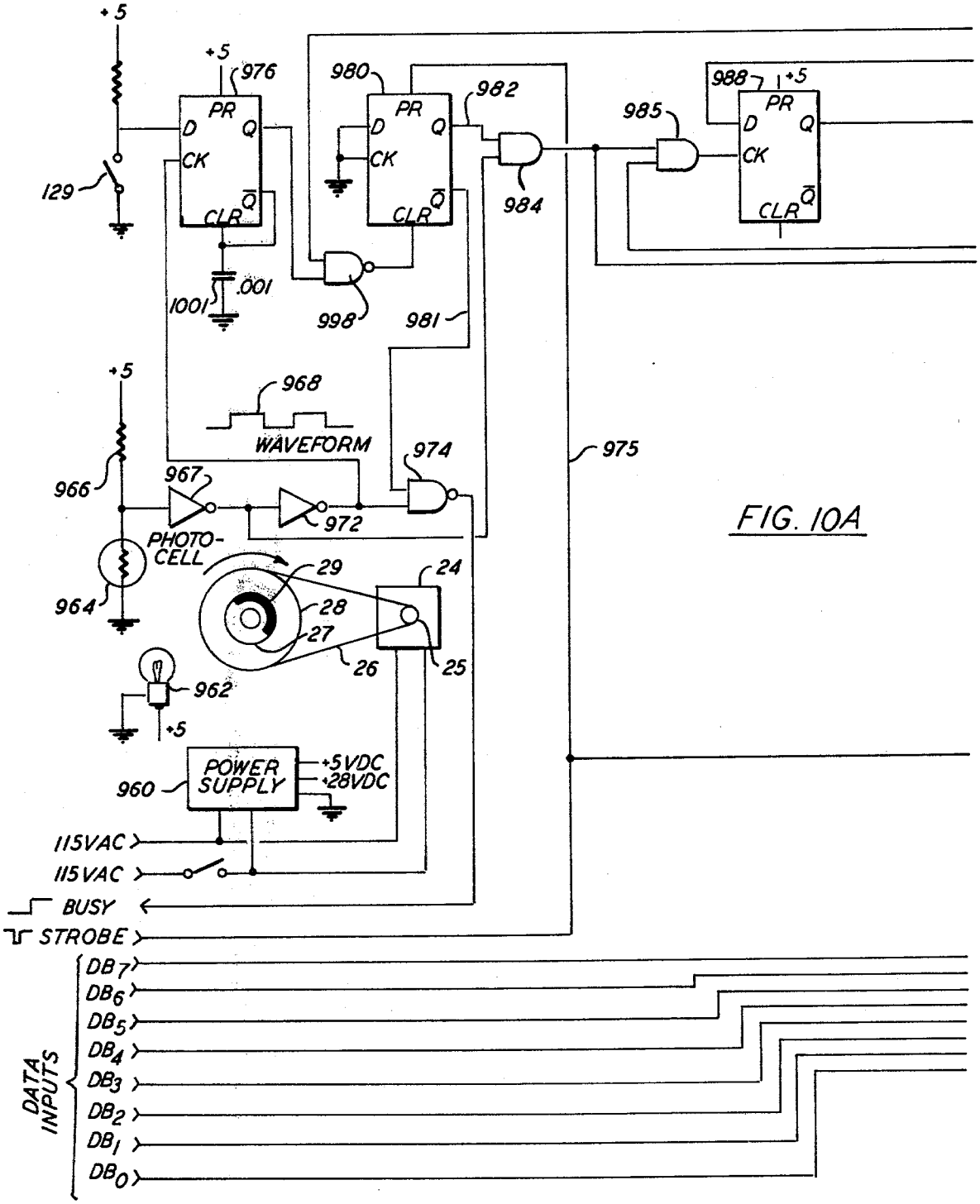
Figure 10B:
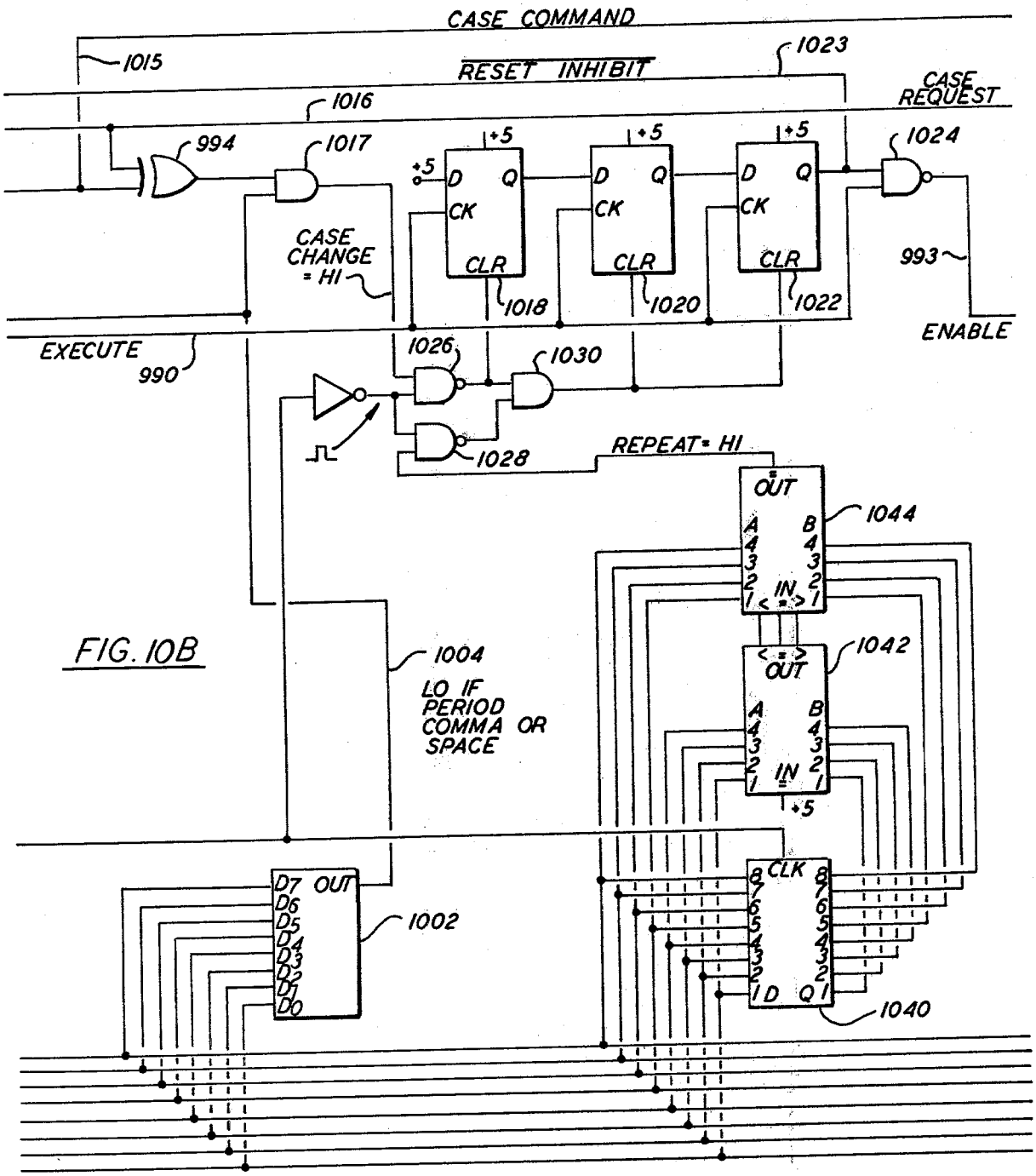

FIG. 10 shows the relationship of FIGS. 10A, 10B and 9B.

FIG. 10A is a left portion of a schematic block diagram of a second embodiment of a digital control system according to the present invention.

FIG. 10B is a center portion of a digital control system according to a second embodiment of the present invention.

DETAILED DESCRIPTION OF PREFERRED EMBODIMENTS OF THE INVENTION

Figure 1:
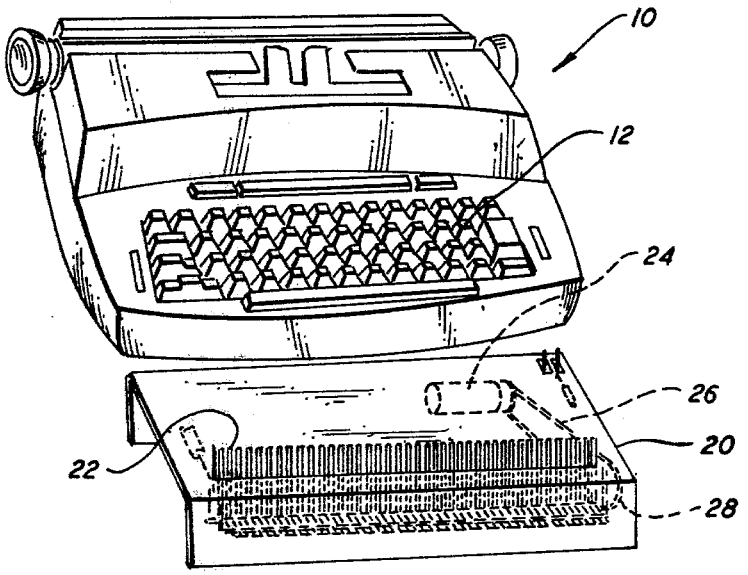
FIG. 1 is a perspective front view of an electric typewriter with a phantom view of a digital control system according to the present invention.
Figure 2:
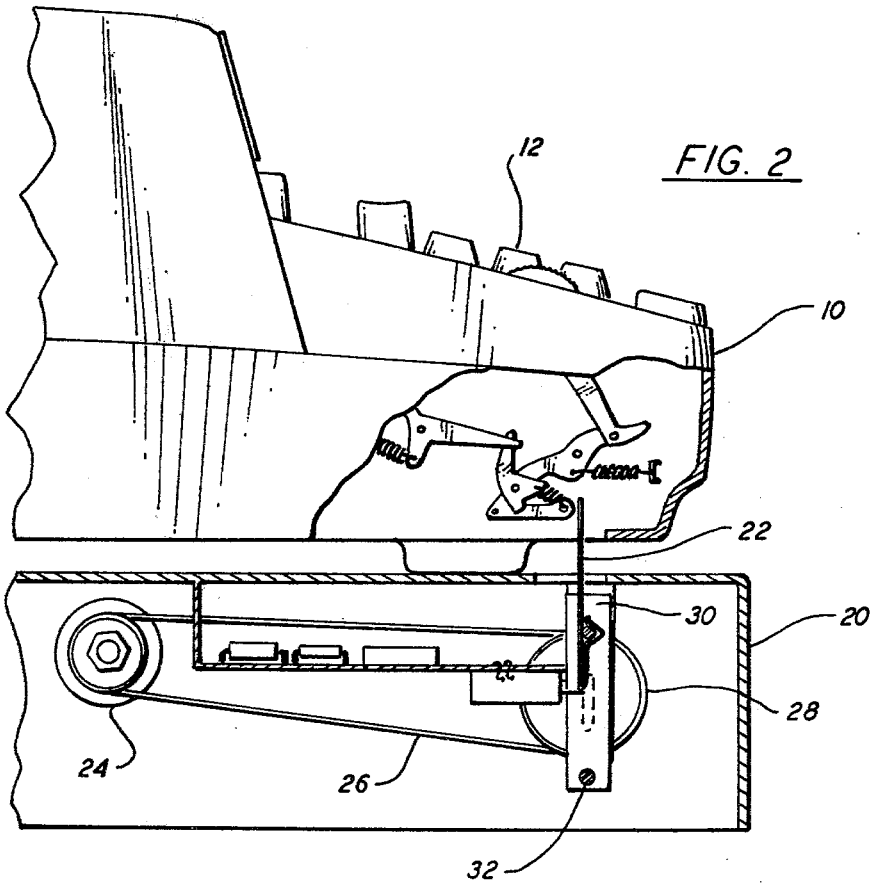
FIG. 2 is a side plan view of the electromagnetic actuation mechanism according to the present invention in alignment with key levers of an electric typewriter.

Referring now to FIGS. 1 and 2, an electric typewriter 10 having a plurality of individual keys 12 wherein each key controls an individual type element is mounted on a control system 20 having a plurality of key lever actuation levers 22 wherein there is one actuation lever 22 for each character which the typewriter is capable of printing and one actuation lever 22 for the space bar function. The carriage return and case shift are operated by independent solenoids. A drive motor 24 is connected by belt 26 to pulley 28 to drive the key lever actuation frame 30.

Figure 3:
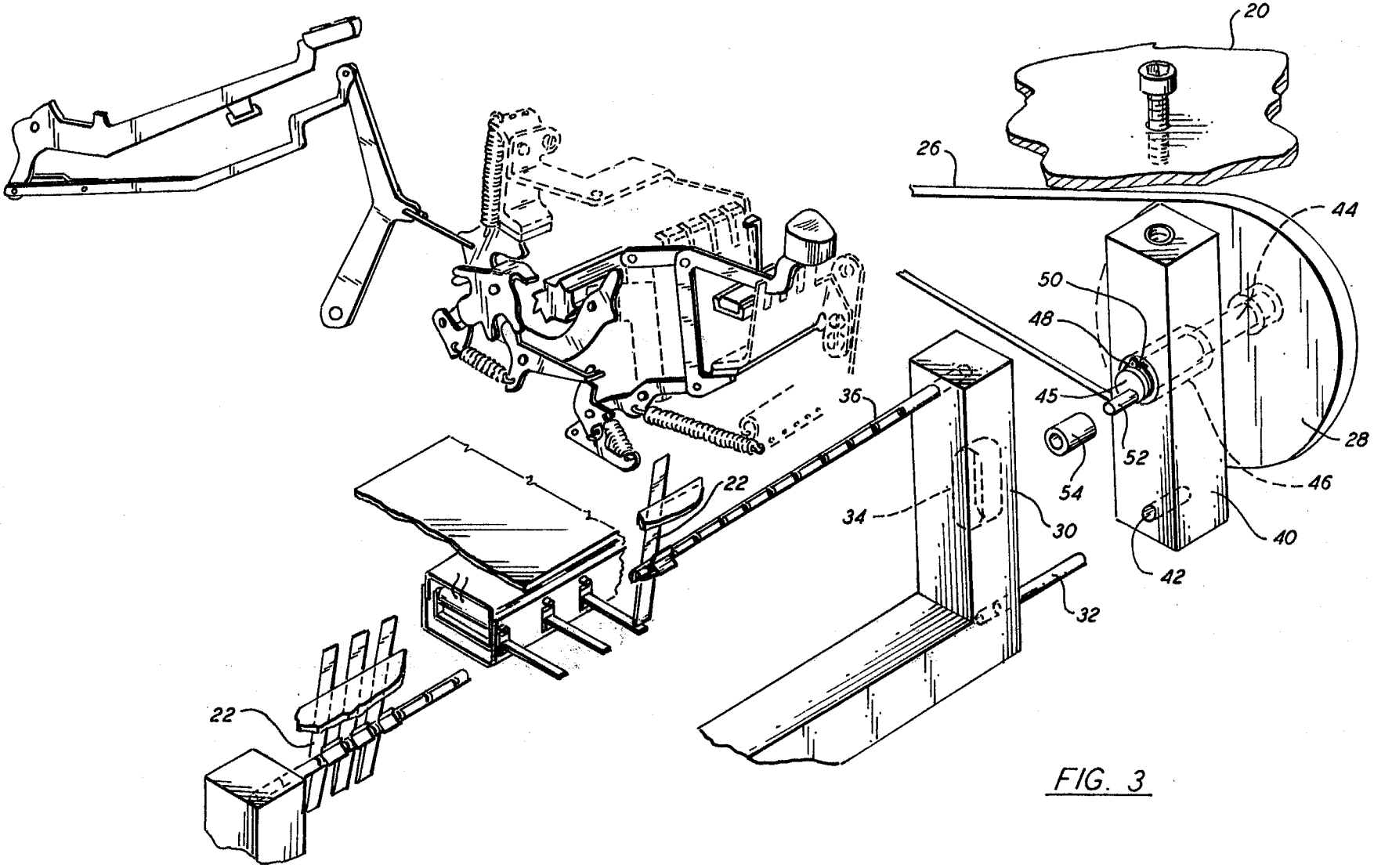
FIG. 3 is a perspective view of the system according to the present invention for actuating a plurality of key levers in an electric typewriter with the key mechanism of a standard electric typewriter shown in dotted lines.

Referring to FIG. 2, a cut away side view of the actuation mechanism in alignment with key levers in electric typewriter 10 is shown in greater detail. Actuation frame 30 is typically mounted to stationary frame 40 (See FIG. 3) by mounting rod 32. Mounting rod 32 is rotatably mounted into hole 42 near the bottom of frame 40.

Pulley 28 is mounted on shaft 44 which is rotatably mounted in bushing 46 in frame 40. At the end of shaft 44 opposite to the point at which pulley number 28 is mounted, a spring clip 48 retains shaft 44 in place. Spring clip 48 is fixed in groove 50 in shaft 44. Spring clip 48 prevents shaft 44 from sliding out during the rotation of pulley 28.

An eccentrically mounted pin 52 is fixed to the face 45 of shaft 44. Pin 52 fits into bushing 54 which rides in vertical slot 34 in actuation frame 30. Longitudinal rod 36 is mounted near the top of actuation frame 30 and carries a plurality of clip mounted levers 22.

Referring now also to FIGS. 4a, 4b, and 4c, a sequence of operation will be described. As motor 24 revolves, causing pulley 28 to revolve, eccentric pin 52 causes bushing 54 to oscillate longitudinally. This motion, captured by slot 34, causes the pivotally mounted actuation frame 30 to move through an arc about pivot 32. In the position shown in FIG. 4a, the electromagnetic actuator assembly 60 has not been set. That is the armature 62 of assembly 60 is in its inactive or OFF position indicating that a particular key element associated with lever 22 has not been selected to be printed on the particular operation stroke described by FIG. 4a. Armature 62 of assembly 60 has a vertical portion 64 and an extended horizontal member 66 which extends beyond the assembly 60. Vertical portion 64 is within the frame 68 of assembly 60 to prevent rotation of the armature. Spring 70 forces armature 62 to the OFF position unless the spring force is overcome by the electromagnetic force generated by winding 72 under the control of the digital selection circuitry to be later described.

Note that in the configuration shown in FIG. 4a, lever 22 does not apply any force to typewriter key lever 14 since horizontal member 66 of armature 62 is not in a position so as to contact the lower end 39 of lever 22.

Referring now to FIG. 4b, the actuation frame 30 has been moved to the opposite end of the arc through which it is permitted to travel as pulley 28 rotates 180° from the position shown in 4a. Eccentric pin 52 and thus bushing 54 have ridden to an extreme end of slot 34 and returned to an approximate midrange position of slot 34 with the actuation frame 30 in the position opposite to that shown in FIG. 4a. Lever 22 is far removed from key lever 14 so that no print action can occur during this part of the operational cycle. It is during this portion of the operation cycle that the appropriate armature 62 of the selected character for the next operational cycle is selected.

Referring now to FIG. 4c, the next cycle of operation is shown in which armature 62 has been set to the ON position indicating that the particular character associated with the particular assembly 60 and lever 22 is to be printed on the present cycle. Horizontal member 66 contacts lower portion 39 of lever 22 as the actuation frame 30 is moved to the left most position of its arc as driven by pulley 28 through eccentric pin 52 and bushing 54 as before. The end of armature member 66 acts as a fulcrum which causes lever 22 to travel through a greater arc and which moves key lever 14 from its rest position as shown in FIG. 4a and 4b to its active position whereby the character associated with the selected key lever will be printed by the drive mechanism of the typewriter.

While the description has generally described the operation of a system for controlling an electric typewriter, it should be pointed out that an SCM Smith-Corona Coronet Super 12 electric typewriter is used in an embodiment of the present invention. Other electric typewriters having key levers in a row would be equally adapted to the digital control system according to the present invention as shown in the preferred embodiment.

It should also be understood that the present invention is not limited to electric typewriters having a single row of key levers but may be adapted to any number of key lever configurations in commonly available low-cost electric typewriters.

Referring to FIGS. 5 and 6, the mechanism for controlling the case shift will be described. In the electric typewriter used with a preferred embodiment of the present invention, the case shift mechanism is biased to the lower case position and may be driven to the upper case position either by depression of the case shift key on the key board or by the mechansim shown in FIGS. 5 and 6. Case shift lever 102 is mounted in alignment with typewriter case shift actuation rod 104 on mounting bracket 106. A solenoid 108 is mounted on bracket 106 in a position so as to move lever 102 through an arc about turning point 110. Turning point 110 is mounted to frame 106 by member 112.

In operation when an upper case character is to be selected solenoid 108 is actuated causing lever 102 to be pulled into contact with typewriter upper case shift rod 104 causing the typewriter shift mechansim to be operated. When the upper case character use has terminated, solenoid 108 is deactivated winding 114 is deactivated causing solenoid 108 to releasing arm 102 allowing spring 116 to return arm 102 which allows the typewriter mechanism to return to lower case operation.

Referring now to FIGS. 7 and 8, the carriage return actuation will be described. In an electric typewriter used with a preferred embodiment of the present invention, a cable 122 is used to actuate a series of levers which operate the carriage return mechanism. Cable 122 is attached to one end of arm 124 which is pivotally mounted at point 126. Remote actuation lever 130 is pivotally mounted at point 134 to support member 136 which is attached to frame member 132. The pivot point 134 is intermediate between the two ends of lever 130. The free end of lever 130 opposite the point of contact with typewriter mechanism 124 is pivotally connected to armature 138 of solenoid 140. Solenoid 140 is also mounted on frame member 132.

In operation, when a carriage return signal is received by the electronic circuitry to be later described, solenoid 140 is actuated, pulling armature 138 causing the upper end of lever 130 to make contact with typewriter carriage return lever 124 moving lever 124 about pivot point 126. As lever 124 reaches its activated position for carriage return operation, lever 128 contacts switch armature 129 causing switch 129 to be closed and remain closed until the carriage return operation is completed. This provides a carriage return signal to be used by the digital control circuitry according to the present invention. After the carriage return operation has been initiated, solenoid 140 is deactivated, allowing spring 142 attached to armature 138 to pull lever 130 out of engagement with typewriter lever 124.

Having described the mechanical features of the preferred embodiment of the present invention with reference to FIGS. 1–8, a sequence of operation of the system according to the present invention will now be described with reference to FIGS. 9A and 9B a circuit diagram of the digital control circuit according to the present invention.

A character is presented in ASCII code on data inputs DBO–DB7. The ASCII code is a seven bit code with a parity bit for error checking of data transmission. The data is presented to read only memory devices 902 and 904 which may be commercially available integrated circuits 82S129 manufactured by Signetics Corp. or a number of other semiconductor manufactures. Read only memory devices 902 and 904 provide a look-up table for the information on the input lines to provide output data and control signals. Read only memory 904 provides the low order four bits of the output character data which is connected in parallel to three identical 4 to 16 bit converters 906, 908, and 910 respectively.

The 4 to 16 bit converters 906, 908, and 910 are commercially available integrated circuits SN74154 or similar devices. Read only memory 902 provides control signals on lines 912, 914, 916, and 918. The control signal on lines 914, 916, and 918 provide an enable signal to the appropriate one of converters 906, 908, 910 which in conjunction with the output of read only memory 904 selects one of 46 lines to be activated at the outputs of the converters 906, 908, and 910. To achieve proper signal polarity, the outputs of the converters 906, 908, 910 are connected to a number of inverter circuits 920, 922, 924, 926, 928, 930, 932, and 934. Each of the blocks 920 through 934 is an integrated circuit such as integrated circuit SN7404 which is commercially available from a number of semiconductor manufactures. Each integrated circuit SN7404 contains six digital inventing circuits of a type well-known to those skilled in the art. The outputs from the inverters 920–934 are connected to magnet driver circuits 936, 938, 940, 942, 944, 946, and 948. The driver circuits may be commercially available integrated circuits ULN 2003A manufactured by Texas Instruments and others. Each integrated circuit ULN 2003A contains therein 7 magnet driving circuits of a type well-known to those skilled in the art.

There are 45 electromagents being driven by the driver circuits 936–948 respectively and two additional solenoids 108 and 140 for driving the case shift and the carriage return mechanisms respectively.

An ac to dc converter 960 converts a common 115-volt 60 cycle ac input to the necessary dc voltages for operating the apparatus according to the present invention.

Motor 24 described earlier with respect to FIGS. 1 and 2 is a single phase shaped pole ac motor operating from the commonly available 115-volt ac line at a nominal rotational speed of 3000 revolutions a minute or 50 revolutions per second. Pulley 28 rotates at approximately 1/5 the speed of the shaft 25 of motor 24. Thus pulley 28 revolves at approximately 10 revolutions per second. A portion 27 of pulley 28 has a blackened area 29 around 180° of the circumference of the pulley 28.

A light source 962 is mounted in a position whereby light emanating from source 962 impinges upon the portion 27 of rotating pulley 28. A photosensitive resistor 964 is mounted in a position so as to be facing light reflected from portion 27 of pulley 28. As pulley 28 rotates, darkened portion 29 alternately inhibits and allows reflection of light from source 962 to photosensitive resistor 940 on alternate half cycles of rotation of pulley 280. When a sufficent quantity of light strikes photosensitive resistor 964, the resistance value decreases causing point 966 to approach zero volts from the positive. That is, there will be a change in level at point 966 from approximately plus 5 volts to approximately zero volts. The waveform 968 on the output of inverter 967 is shown as an approximate square wave. Waveform 968 is presented to the clock input of case shift flip-flop 970, to inverter 972 and to gate 984. The output of inverter 972 which is the inverted waveform 968 is connected to the clock input of flip-flop 976 which is the carriage return flip-flop and to an input of busy gate 974.

When waveform 968 is high, the output of busy gate 974 will be high inhibiting transfer of data from the data source to the control system according to the present invention. When waveform 968 goes low, data may be accepted and data is assumed to have been stable on data input lines DBO–DB7 for sufficient time to have fully propagated its effects throughout the circuit when a strobe appears on line 975. Flip-flop 980 is set by strobe 975 generating a print request on line 982 which ANDED with waveform 968 in gate 984 which may be implemented by commercially available integrated circuit SN7408 to provide an execute command which is presented to the clock input of flip-flop 988 and on line 990 to print enable gate 992.

Assuming no case shift is involved in the character to be printed, print enable line 993 partially enables 4 to 16 bit decoders 906, 908, and 910 to decode the data on data input lines DBO–DB7 and converted by read only memory devices 902 and 904. One of the output lines from converter 906 or 908 or 910 will become active and a signal on such line will be inverted by one of the inverters in integrated circuits 920–934 and one of the drivers contaned in driver circuits 936–948 wll become active causing one of electromagnetic actuators 60 to become active and set a print condition for the selected character.

If a change or shift in case such as from lower case to upper case occurs in the data input, the level on line 912, the D input of flip-flop 988, will be different from the level on line 989, the Q output of flip-flop 988. This difference will be detected by EXCLUSIVE OR gate 994 which typically might be a commercially available SN7486 integrated circuit. The output of EXCLUSIVE OR case shift detecting gate 994 is inverted by inverter 996 and presented to the D input of case change flip-flop 970.

In the event that the previous character case is different from the case of the character to be printed presently, the Q output of case shift flip-flop 970 will present an inhibit level on line 997 to print enable gate 992 and to the reset inhibit gate 998. The Q output of flip-flop 988 activates line 989 causing shift solenoid 108 to be energized shifting the case of the typewriter as described previously with respect to FIGS. 5 and 6. Reset gate 998 is inhibited, preventing a reset signal from being applied to flip-flop 980 thus keeping the busy signal and print request activated during the case shift operation.

The next time that wave form 968 goes high, an execute command will be again generated but in this situation since solenoid 108 has been activated shifting the case mechanism of the typewriter, EXCLUSIVE OR gate 994 will indicate that the case of the previous attempt and the case of the present attempt are the same. The Q output of flip-flop 970 will now enable print enable gate 992 to generate the print enable signal 993 to converters 906, 908, and 910. Also, the next time that wave form 968 goes high, a pulse will be generated at the Q output of flip-flop 976 connected as a one-shot by means of capacitor 1001. With line 997 now being high, a reset pulse will be generated by 998 to reset flip-flop 980 allowing the data source to send the next character.

During a carriage return operation, carriage return switch 129 is closed as described with reference to FIGS. 7 and 8, causing input D on one-shot connected flip-flop 976 to be held low. This precludes the generation of a pulse at the Q output thus inhibiting the resetting of busy flip-flop 980.

Referring now to FIGS. 10A, 10B, and 9B a second embodiment of the digital control circuit according to the present invention will be described. The circuit shown in FIGS. 10A and 10B has certain modifications over the circuit shown in FIG. 9A which allow a higher speed of operation of the printing mechanism of an electric typewriter used with the control circuit according to the present invention.

The limiting factor in operational speed of an electric typewriter of the type used with the present invention is the time required for a key to strike the platen and return to the rest position. Until the key returns, the typewriter mechanism is not able to reinitiate the key stroke on the same key. An attempt to repeat a given key at a rate faster than permitted by the travel time of the key from rest to print and back to rest would normally result in the print request being lost. This is due to the fact that the mechanism would provide a mechanical initiation to the key lever while the key lever is not able to accept such movement as the key stroke initiation.

If, however, different keys were being sequentially selected, a significantly faster operating speed could be achieved. A key stroke may be initiated while a previous key is still returning from the print position to the rest position.

To permit a higher rate of speed of operation of the apparatus according to the present invention, pulley 28 is reduced in size to change the rotation ratio between pulley 28 and shaft 25 of motor 24. Thus instead of pulley 28 rotating approximately one time for each five revolutions of shaft 25, pulley 28 may rotate one time for every approximately 2.5 rotations of shaft 25.

FIGS. 10A and 10B show the control portion of a circuit according to a second embodiment of the present invention. The lines at the right most edge of FIG. 10B communicate directly with and are attached to the corresponding lines at the left most edge of FIG. 9B. Thus the circuit of FIGS. 10A and 10B is a direct replacement for the circuit of FIG. 9A.

There are two speed up mechanisms employed in the circuit shown in FIG. 10. The first is as described above and is implemented by latch 1040 which stores the previous character and an 8 bit comparator comprised of blocks 1042 and 1044 which compares the present character on data lines DBO–DB7 with the latched previous character.

If a repeat character is detected, the output of the comparator from block 1044 is high. This signal is ANDED with the strobe signal in gate 1028 thus providing a low going pulse to gate 1030. A low input on either of the input lines to gate 1030 causes the delay flip-flops 1020 and 1022 To be reset. If a flip-flop 1022 is reset line 1023 will be low which will inhibit reset gate 998 keeping the busy signal and print request activated. Also, the execute gate 1024 is disabled by line 1023 being low, preventing any execute signal from being transmitted on line 993 to the decoders 906, 908, and 910.

When waveform 968 next goes high, which will initiate the first attempt to print the repeat character, the execute line 990 will go high causing the Q output of flip-flop 1020 to go high. Line 1023 the Q output of flip-flop 1022 will not go high, however, unitl the following execute attempt thus providing one cycle of delay before printing the repeat character.

If a sequence of data indicates that two successive character requests on data input lines DBO–DB7 represent different characters to be printed, the output of comparator 1044 will be low, thus inhibiting gate 1028 and preventing the resetting of delay flip-flops 1020 and 1022. The execute signal will then be gated through gate 1024 on its next positive half cycle.

Another modification to the circuit which will eliminate unnecessary case shift operations and thus increase the speed of operation of the apparatus according to the present invention is to determine those characters which print the same in either upper or lower case.

Examples of these characters are period, space and comma.

Read only memory 1002 decodes the character transmitted on data input lines DBO–DB7. If a character which is the same in both upper and lower case is detected, such as period, space or comma, line 1004 goes low disabling gates 985 and 1017. The case being requested on line 912 will be ignored since the clock input to flip-flop 988 is inhibited by disabled gate 985. Gate 1017, being disabled, will have a low output indicating no case change to the input of gate 1026. Thus during this cycle, no change on the case request line 912 will be stored in flip-flop 988 nor will any case comparison results from EXCLUSIVE OR gate 994 be used. The character will therefore print in whatever case was last used.

For all characters which print differently in upper and lower case, read only memory 1002 will provide a high output on line 1004 thus enabling gates 985 and 1017. The output of the last case flip-flop 988 is presented as one input to EXCLUSIVE OR gate 994 and generates a case command signal on line 989. EXCLUSIVE OR gate 994 then determines if the current case request and the last case are the same. If the case has shifted, gate 1026 is enabled. At the time of the next strobe pulse, the strobe signal passes from inventor 1032 through gates 1026 and 1030 to set delay flip-flops 1018, 1020, and 1022.

As discussed above with respect to the comparator operation, the execute command is inhibited in gate 1024 for a number of cycles determined by which of delay flip-flops 1018, 1020, and 1022 have been reset. In the instant situation, with a shift in case, there will be a delay of two cycles to allow the execute signal to be shifted through flip-flops 1018, 1020 and 1022 so that on the third rising of the execute signal, gate 1024 will be enabled allowing the execute signal to be passed to the decoder.

Each of the mofifications discussed above with respect to a second embodiment of the present invention enables the apparatus according to the present invention to operate faster than any known prior art control system for electric typewriters having individual key actuators for each character to be printed.

Although the invention has been described with reference to a preferred embodiment thereof, it will be understood by those skilled in the art that various changes in circuitry and in mechanism may be made without departing from the spirit or scope of the invention.

What is claimed is:

1. A control system for controlling the actuation of key levers in an electric typewriter having a separate key lever for each key, said key levers being actuated in a sequence determined by data transmitted from a remote control device, comprising:

a plurality of drive levers, there being one drive lever for each of said key levers in said electric typewriter, said drive levers being pivotally mounted on a drive frame adapted to carry said drive levers to said key levers and to drive a selected one of said key levers;

a plurality of actuators, there being one of said actuators associated with each of said drive levers, one of said actuators being selected by said data to alter a position of a selected one of said drive levers on said drive frame;

drive means for driving said drive frame to effect printing of a selected character by said typewriter; and electronic circuit means for decoding received data indicating a character to be printed and for selecting one of said actuators representative of a character being printed.

2. Apparatus according to claim 1 further comprising, means for detecting a case shift requirement and electromechanical means for operating a case shift lever within said typewriter.

3. Apparatus according to claim 2 further comprising circuit means for detecting characters which are identical in upper and lower case and eliminating case shift operation for such characters.

4. Apparatus according to claim 1 further comprising means for detecting a carriage return requirement and for controlling an electromechanical device for operating a carriage return mechanism within said typewriter.

5. Apparatus according to claim 4 further comprising means for detecting when a carriage return operation has been completed.

6. Apparatus according to claim 1 wherein said drive means comprises an electric motor drive apparatus which is independent from an internal drive motor within said typewriter and asynchronous with respect to said typewriter drive motor.

7. Apparatus according to claim 1 further comprising circuit means for determining a repeat character requirement, said circuit means comprising means to delay initiation of a repeat character print operation.

8. Apparatus according to claim 7 wherein said circuit means further comprises means for inhibiting data transmission to the control system until said repeat character printing has been substantially completed.

9. Apparatus according to claim 1 wherein said electronic circuit means comprises:

Means for decoding a received data signal to determine a character to be printed;

Converter means connected to said decode means for converting signals representative of a character to be printed from a first data format to a second data format; and drive circuit means connected to outputs of said converter means for supplying operating voltage to an appropriate actuator representative of a character to be printed.

10. Apparatus according to claim 1 wherein said plurality of drive levers are pivotally mounted in alignment with said actuators adjacent one end of said drive levers and in alignment with said key levers at a second end of said drive levers such that when one of said actuators is set to a print condition, said drive lever contacts and drives said key lever on a next power stroke of said drive means causing a character to be printed by an internal drive motor within said electric typewriter.

* * * * *